US006672546B2

(12) United States Patent
Calleja

(10) Patent No.: US 6,672,546 B2
(45) Date of Patent: Jan. 6, 2004

(54) WAREHOUSE MATERIAL-BAY SAFETY-CABLE SYSTEM

(76) Inventor: Michael J. Calleja, 110 San Benito Rd., Brisbane, CA (US) 94005

( * ) Notice: Subject to any disclaimer, the term of this patent is extended or adjusted under 35 U.S.C. 154(b) by 0 days.

(21) Appl. No.: 10/096,152

(22) Filed: Mar. 12, 2002

(65) Prior Publication Data

US 2003/0173317 A1 Sep. 18, 2003

(51) Int. Cl.[7] ..... E21F 17/01
(52) U.S. Cl. ..... 248/58; 248/65
(58) Field of Search ..... 248/49, 61, 58, 248/65, 300; 211/60.1, 119.01, 119.17, 119.11, 175, 189; 292/302; 74/502.4, 502.6; 403/353; 224/521, 534, 331, 200

(56) References Cited

U.S. PATENT DOCUMENTS 1,642,707 A * 9/1927 Wichert ..... 24/115 R
3,494,849 A * 2/1970 Hess ..... 204/196.16
3,677,562 A * 7/1972 Bronstein ..... 410/97
3,960,301 A * 6/1976 Miller ..... 224/318
4,011,974 A * 3/1977 Scarola ..... 224/318
4,014,504 A * 3/1977 Sachs ..... 248/61
4,096,816 A * 6/1978 Patterson et al. ..... 114/75
4,225,265 A * 9/1980 Hooker et al. ..... 403/353
4,297,069 A * 10/1981 Worthington ..... 414/462
5,120,094 A * 6/1992 Eaton et al. ..... 292/159
5,161,700 A * 11/1992 Stannis et al. ..... 211/175
5,595,333 A * 1/1997 Boston ..... 224/536
5,624,045 A 4/1997 Highsmith ..... 211/192
5,685,470 A * 11/1997 Moore ..... 224/567
6,039,227 A * 3/2000 Stark ..... 224/521
6,280,128 B1 * 8/2001 Schrader ..... 410/97

* cited by examiner

*Primary Examiner*—Ramon O. Ramirez
*Assistant Examiner*—Amy J. Sterling
(74) *Attorney, Agent, or Firm*—Robert Charles Hill

(57) ABSTRACT

A safety cable and rack system comprises tubular material-bay dividers with wire-rope safety-cable gates and easy-to-release cable clips. Long sticks or sheets of material are stood on-end inside the bays for retail display. The cable clips are mounted on the front edges of the tubular material-bay dividers and the wire-rope safety-cable gates are secured to prevent the retail material from falling out onto the aisleways. A sliding lock on the cable clips has an enlarged hole that can be aligned to allow a beaded end of the wire-rope safety-cable gates to be secured or released. Such sliding lock is loosely attached, and will fall into a cable-locked position when not held up.

7 Claims, 3 Drawing Sheets

WAREHOUSE MATERIAL-BAY SAFETY-CABLE SYSTEM

BACKGROUND OF THE INVENTION

1. Field of the Invention

The present invention relates to material-rack safety systems, and more particularly to easy-to-disconnect safety cables that restrain vertical stands of board and stick materials in divided display racks.

2. Description of Related Art

A typical warehouse retail store, like The Home Depot, has divided racks for displaying wood moldings, corrugated roofing, and lumber, where the material is stood on-end and tilted-in to stay put. But very little keeps the 6–20 foot long pieces in place in their divided racks. Not stacking the material right, bumping it, or an earthquake could result in a lot of heavy, dangerous material raining down on customers and workers.

So a number of devices have been developed in the prior art to keep such material in their divided racks. Those devices that are too difficult to be installed, don't get installed. Those that are too difficult to secure, don't get secured. And those mechanisms that are too difficult to disconnect or open can impede sales, or make the customer seek store-employee help. All of these things can work against the retail sales concept of self-help customers in warehouse stores.

A latched beam-to-column storage rack connector is described by Charles Highsmith, et al., in U.S. Pat. No. 5,624,045, issued Apr. 29, 1997. Here an improved hook-and-peg arrangement is disclosed. The problem of bumping the retaining bar up and unlatching it inadvertently was recognized. The configuration described supposedly overcomes such troubles.

SUMMARY OF THE INVENTION

Briefly, a safety cable and rack system embodiment of the present invention comprises tubular material-bay dividers with wire-rope safety-cable gates and easy-to-release cable clips. Long sticks or sheets of material are stood on-end inside the bays for retail display. The cable clips are mounted on the front edges of the tubular material-bay dividers and the wire-rope safety-cable gates are secured to prevent the retail material from falling out onto the aisleways. A sliding lock on the cable clips has an enlarged hole that can be aligned to allow a beaded end of the wire-rope safety-cable gates to be secured or released. Such sliding lock is loosely attached, and will fall into a cable-locked position when not held up.

An advantage of the present invention is that a safety restraint is provided that is easy and simple to use.

Another advantage of the present invention is that a safety cable and rack system is provided for retail home-improvement warehouse use.

A further advantage of the present invention is that a safety cable system is provided that cannot be bumped or jarred into releasing the restraint gates.

The above and still further objects, features, and advantages of the present invention will become apparent upon consideration of the following detailed description of specific embodiments thereof, especially when taken in conjunction with the accompanying drawings.

BRIEF DESCRIPTION OF THE DRAWINGS

FIG. 2A shows the cable secured, and where FIG. 2B shows the cable on the right after release.

DETAILED DESCRIPTION OF THE INVENTION

Figure 1:
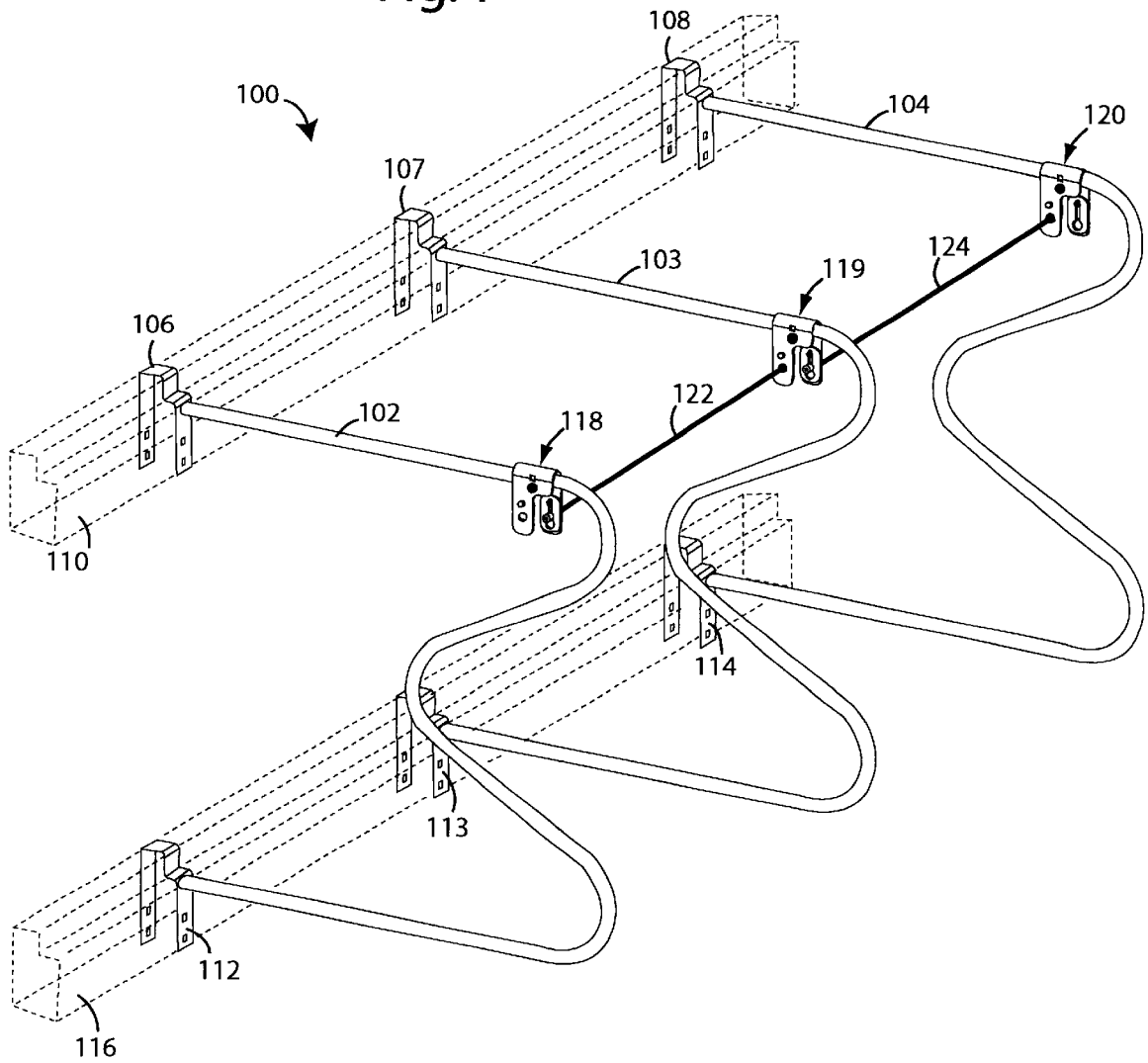
FIG. 1 is a perspective view of a safety cable and rack system embodiment of the present invention.

FIG. 1 illustrates a safety cable and rack system embodiment of the present invention, referred to herein by the reference numeral 100. The implementation shown has two bays for vertically standing long boards or material sheets in retail displays in home-improvement warehouse stores, etc. Any number of bays can be used. The safety cable and rack system 100 comprises a number of bay dividers 102–104 that are respectively anchored with top clamps 106–108 to a back brace 110 and bottom clamps 112–114 to another back brace 116. Retail merchandise standing in the bays is secured behind a set of cable clips 118–120 and restraining cables 122 and 124. Such cables can be wire-rope, such as braided stainless steel, or may be of strong plastic like nylon. The cables 122 and 124 shown in FIG. 1 only bridge a single bay and so two are shown for two bays. However, a longer cable can be used instead to bridge across two or more such bays.

The cable clips 118–120 offer an exceedingly easy way to secure and release restraining cables 122 and 124. A sliding gate on each of the cable clips 118–120 drops under gravity over a beaded end of each end of the restraining cables 122 and 124. Simply bumping the cables or the clips will not cause an accidental release.

Figure 2A:
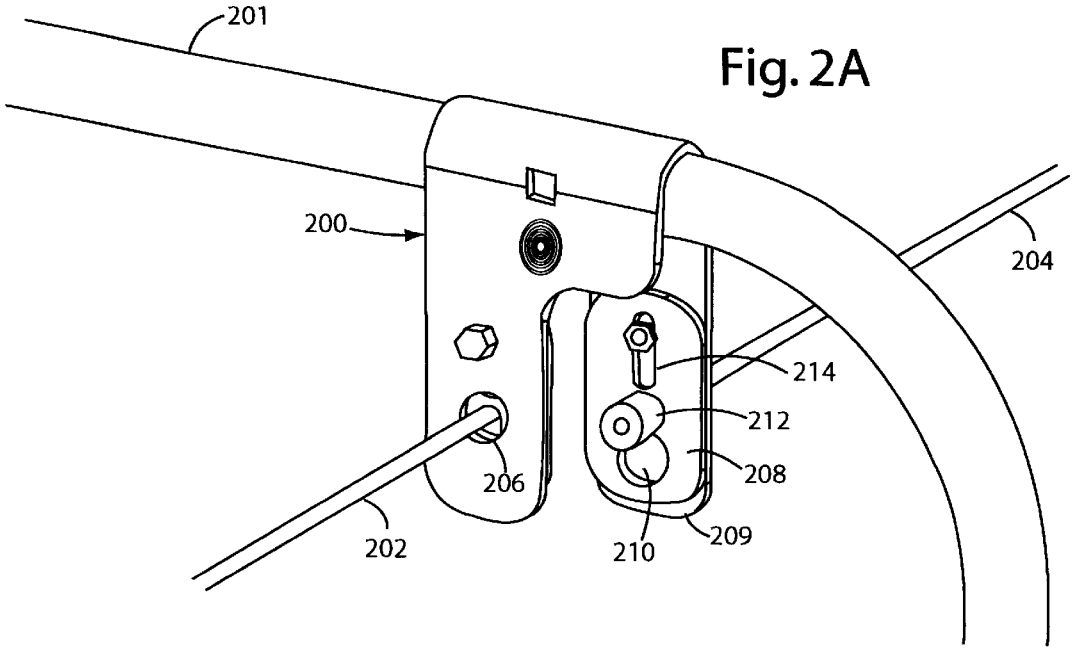
FIGS. 2A and 2B are perspective views of the easy-release cable clamps used in the system of FIG. 1, where
Figure 2B:
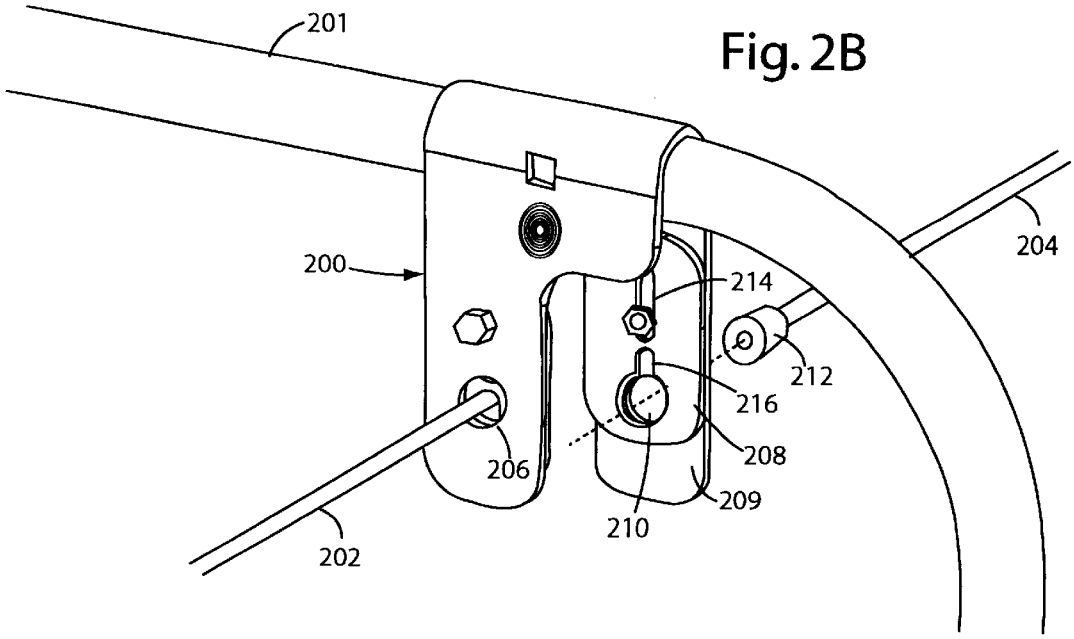

FIGS. 2A and 2B show such cable clips and restraining cables in more detail. In FIG. 2A, a cable clip 200 is shown mounted to a divider tubing 201. Such cable clip 200 can be symmetrical, so it will mount either way and look the same. In FIG. 2A, a left safety cable 202 is shown secured, as is a right safety cable 204. Such cables are preferably constructed of stainless-steel wire rope with plastic sheathing. A hole 206 in the body of the cable clip 200 allows one end of the safety cables to be threaded through and captured by a sliding gate 208 mounted on an ear 209. A hole 210 in the sliding gate 208 can be aligned by the user with hole 206 by lifting the sliding gate 208 to allow for capture and release of a beaded-cable end 212. An attachment slot 214 allows the sling gate to be retained on the body of the cable clip 200. A bolt with double nuts or an aircraft type nut is used to allow some play and slippage along slot 214.

FIG. 2B shows sliding gate 208 lifted so that holes 206 and 210 are aligned. If let go, the sliding gate 208 is attached loose enough to ear 209 that it will drop closed on its own. The cable 204 and its beaded end 212 are shown disconnected from cable clip 200. A slot 216 extends up from hole 210 and is the piece that actually collars and locks onto cable 204 behind beaded-end 212. In one embodiment of the present invention, hole 210 had a diameter of 0.625", and slot 216 was 0.375" long and about 0.28" wide. The cable 204 was a wire-rope type with a diameter of 0.1875". The beaded-end had a diameter of 0.50" and was swaged on the cable. The ratio of the cable diameter to the width of slot 216 was therefore about 2-to-3 (67%). Or stated the other way, the slot diameter is preferably 3-to-2 (150%) the width of slot 216. Such is preferred for both easy and secure operation.

Figure 3:
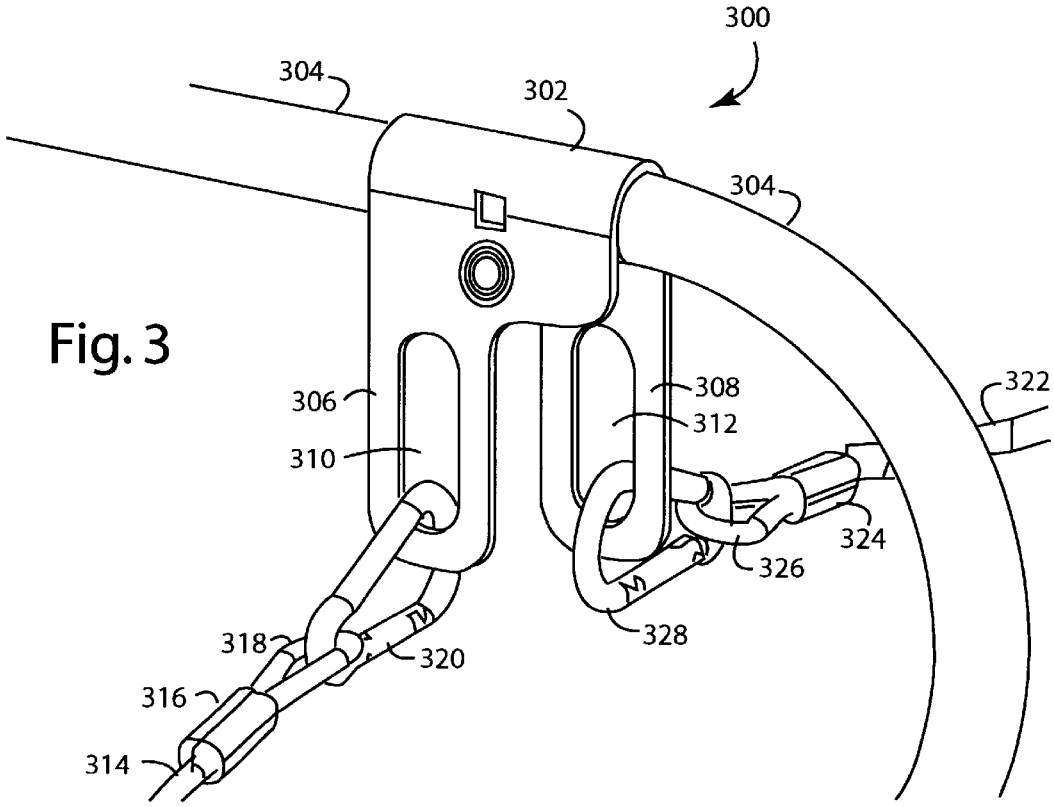
FIG. 3 is a perspective view of an alternative cable and clamp embodiment of the present invention that can be used instead of those shown in FIGS. 1, 2A, and 2B.

FIG. 3 illustrates an alternative cable and clamp system 300. Such can be used instead of those shown in FIGS. 1, 2A and 2B. The cable and clamp system 300 comprises a clip 302 that secured with fasteners to a divider tubing 304. The body of the clip 302 has a pair of ears or lobes 306 and 308 that each have holes or slots 310 and 312. These allow restraining safety cables to be hooked on. For example, a left safety cable 314 is prepared with a swedge 316 that secures a loop 318 and a carabiner hook 320. A user can simply hook and unhook carabiner 320 into slot 310. Similarly, a right safety cable 322 is prepared with a swedge 324 that secures a loop 326 and a carabiner hook 328.

Although particular embodiments of the present invention have been described and illustrated, such is not intended to limit the invention. Modifications and changes will no doubt become apparent to those skilled in the art, and it is intended that the invention only be limited by the scope of the appended claims.

What is claimed is:

1. A safety cable and rack system, comprising:

at least two tubular material-bay dividers for mounting to a backing brace or wall and providing for containment of a vertical stand of building materials on retail display;

a safety-cable gate associated with each pair of the material-bay dividers and disposed across the front of them, and providing for spillage restraint of any said vertical stand of building materials inside;

at least one cable latch included in the gate and mounted to the front of a corresponding one of the material-bay dividers and providing for a latch-on and latch-off connection;

at least one cable included in the gate and able to connect to and disconnect from a corresponding cable latch;

a beaded-end disposed on at least one end of the cable for capture by a respective cable latch; and a vertically sliding gate having a slot and a hole to respectively receive the cable and beaded-end, and loosely mounted to a corresponding cable latch such that it automatically captures and retains the beaded-end of the cable once passed through said hole.

2. A safety cable and rack system, comprising:

at least two tubular material-bay dividers for mounting to a backing brace or wall and providing for containment of a vertical stand of building materials on retail display;

a safety-cable gate associated with each pair of the material-bay dividers and disposed across the front of them, and providing for spillage restraint of any said vertical stand of building materials inside;

at least one cable latch baying a clip with a pair of ears, included in the gate and mounted to the front of a corresponding one of the material-bay dividers and providing for a latch-on and latch-off connection;

at least one cable included in the gate and able to connect to and disconnect from a corresponding cable latch; and a carabiner disposed on at least one end of the cable for capturing a respective cable latch.

3. A method for restraining the spillage of a vertical stand of building materials on retail display, the method comprising the steps of:

providing at least two vertical material-bay dividers for mounting to a backing brace or wall to laterally contain a vertical stand of building materials on retail display;

gating said material-bay dividers with a cable having at least one enlarged end;

providing for latching and unlatching said one enlarged end of said cable to allow said vertical stand of building materials to be withdrawn and replenished; and using a vertically sliding-gate piece with a slot and a hole to respectively receive said cable and enlarged end, and loosely mounting it to a corresponding cable latch such that it automatically captures and retains said enlarged end of said cable once passed through said hole.

4. The method of claim 3, further comprising the steps of:

requiring said vertically sliding-gate piece to be manually lifted up so that said enlarged end of said cable can be passed in and out said hole.

5. The method of claim 3, further comprising the steps of:

dropping said vertically sliding-gate piece automatically by force of gravity so that said enlarged end of said cable is latched-in once passed into said hole.

6. A cable latch, comprising:

a body for attachment to a vertical material-bay divider;

a first hole in the body providing for a threading-in of a safety cable with an enlarged end;

a sliding-gate piece loosely attached to the body and proximate to the first hole, and able to move freely up and down relative to the first hole;

a slot vertically disposed in the sliding-gate piece, and having a slot length that aligns proximate to the first hole during an up and down movement of the sliding-gate piece relative to the body and first hole; and a second hole disposed in the sliding gate piece at a bottom end of the slot, and positioned such that it can be aligned by a user with the first hole when the sliding-gate piece is manually lifted up;

wherein, said safety cable can be secured with its enlarged end captured behind the slot after the sliding-gate piece is manually lifted and allowed to drop on its own.

7. The cable latch of claim 6, wherein:

the slot has a width about 150% of the diameter of said safety cable.

* * * * *